US010512292B2

(12) United States Patent
Curtis

(10) Patent No.: US 10,512,292 B2
(45) Date of Patent: Dec. 24, 2019

(54) ACCESSORY FASTENER DEVICE AND METHOD

(71) Applicant: Tina Curtis, Fairfield, CA (US)

(72) Inventor: Tina Curtis, Fairfield, CA (US)

( * ) Notice: Subject to any disclaimer, the term of this patent is extended or adjusted under 35 U.S.C. 154(b) by 89 days.

(21) Appl. No.: 15/699,865

(22) Filed: Sep. 8, 2017

(65) Prior Publication Data

US 2018/0064193 A1 Mar. 8, 2018

Related U.S. Application Data

(60) Provisional application No. 62/384,874, filed on Sep. 8, 2016.

(51) Int. Cl.
*A41F 1/00* (2006.01)
*H01F 7/02* (2006.01)

(52) U.S. Cl.
CPC ..... *A41F 1/002* (2013.01); *H01F 7/0268* (2013.01); *Y10T 24/1391* (2015.01); *Y10T 24/1394* (2015.01); *Y10T 24/32* (2015.01)

(58) Field of Classification Search
CPC ..... Y10T 24/32; Y10T 24/13; Y10T 24/1391; Y10T 24/1394; Y10T 24/1365; A41F 1/002; A44D 2203/00; A45C 13/1069
See application file for complete search history.

(56) References Cited

U.S. PATENT DOCUMENTS 4,249,267 A 2/1981 Voss
4,399,595 A 8/1983 Yoon
5,604,960 A 2/1997 Good
5,682,648 A * 11/1997 Miller ..... A45F 5/08 24/303
5,732,451 A * 3/1998 Mars ..... A44B 9/16 24/303
6,434,801 B2 8/2002 Grunberger
2002/0170147 A1* 11/2002 Heller ..... A45F 5/02 24/3.3
2006/0005361 A1* 1/2006 O' Banion ..... A42B 1/24 24/303
2010/0024175 A1* 2/2010 Cserpes ..... A45F 5/04 24/303
2012/0079688 A1* 4/2012 Bunting ..... A41F 1/002 24/303
2013/0219667 A1* 8/2013 Walczak ..... A44B 99/00 24/3.1
2014/0237796 A1* 8/2014 Durocher ..... A45F 5/02 29/428
2015/0047105 A1 2/2015 Fonzo
2015/0152981 A1* 6/2015 Goodall ..... A44B 99/00 24/303

(Continued)

*Primary Examiner* — Robert Sandy
*Assistant Examiner* — Michael S Lee
(74) *Attorney, Agent, or Firm* — Charles Runyan

(57) ABSTRACT

An accessory fastener device including front and back magnets for securing an accessory to a fabric item or other surface. The front and back magnets may include fabric shields covering a portion of the magnets and are configured to interface with the front and back sides of a fabric item. The accessory fastener may also include an accessory coupling configured to removably couple with the accessory. The device is used to add a plurality of accessories to fashion items, and also as a decorative means for holding and securing items in place.

4 Claims, 5 Drawing Sheets

(56) References Cited

U.S. PATENT DOCUMENTS

| | | | | |
|---|---|---|---|---|
| 2015/0201712 | A1* | 7/2015 | Keller | A44B 6/00 2/116 |
| 2016/0052462 | A1* | 2/2016 | Heilgendorf | B60R 7/08 224/274 |
| 2016/0374438 | A1* | 12/2016 | Fujita | A44B 17/0052 24/303 |

* cited by examiner

ACCESSORY FASTENER DEVICE AND METHOD

CROSS-REFERENCE TO RELATED APPLICATION

The present application is related to and claims priority to U.S. Provisional Patent Application No. 62/384,874 filed Sep. 8, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of decorative accessories and more specifically relates to multi-use fasteners and wearable accessories.

2. Description of Related Art

When it comes to accessories, less is usually more. If the ensemble includes jewelry, a watch, a scarf, a hat and sunglasses, no one piece will stand out, and the outfit ends up looking cluttered. It is also desirable to utilize accessories to identify luggage in order to avoid confusion and allow a user to quickly find his or her luggage among the luggage of others during travel. A user may choose a few accessories that accent the outfit or highlight the feature that should stand out. However, some materials may not be able to support having a large accessory with a pin (e.g., an umbrella). This may cause the material to rip, ruining the article. Clips may also damage the article by fraying the material if the accessory is consistently fastened to the same area on the garment. In the event an accessory becomes caught, it may tear away, destroying the article. Shawls are a great accent piece, but they often fall from the shoulders with movement. A solution is desired to secure accessories without damaging the material.

U.S. Pat. App. Pub. No. 2015/0047105 to Fonzo relates to a magnetic removable closure system. The described magnetic removable closure system includes an all purpose closure system which is particularly designed and intended for use in clothing, underclothing, leather goods, shoes, any accessories and any other field of application. The present closure system permits to join securely different components by attractive action of the magnets. It consists of three separate components, as follows: Fixed part, composed of at least one pocket incorporated into the article(s) or fixed on the surface of the garment; Movable part, composed of two or more flexible removable magnetic strips; Magnet or magnetic attractable member, which helps to insert or slide the magnetic strip into the pocket.

BRIEF SUMMARY OF THE INVENTION

In view of the foregoing disadvantages inherent in the known wearable accessories art, the present disclosure provides a novel accessory fastener device and method. The general purpose of the present disclosure, which will be described subsequently in greater detail, is to provide a fastener that may magnetically couple an accessory to a fabric item or other surface.

An accessory fastener is disclosed herein. The accessory fastener includes a back magnet configured to interface with the back side of a fabric item, a front magnet configured to interface with the front side of the fabric item and magnetically couple with the back magnet while the fabric item is interspersed therebetween, and an accessory coupling fixed to the front magnet configured to removably couple with an accessory.

According to another embodiment, a method of use for an accessory fastener is also disclosed herein. The method of use for an accessory fastener may include providing an accessory fastener such as above, coupling the accessory to the front magnet via the accessory coupling, and magnetically coupling the front magnet to the back magnet with the fabric item interspersed there between such that the accessory is affixed to the fabric item.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an accessory fastener device and method, constructed and operative according to the teachings of the present disclosure.

The various embodiments of the present invention will hereinafter be described in conjunction with the appended drawings, wherein like designations denote like elements.

DETAILED DESCRIPTION

Figure 1:
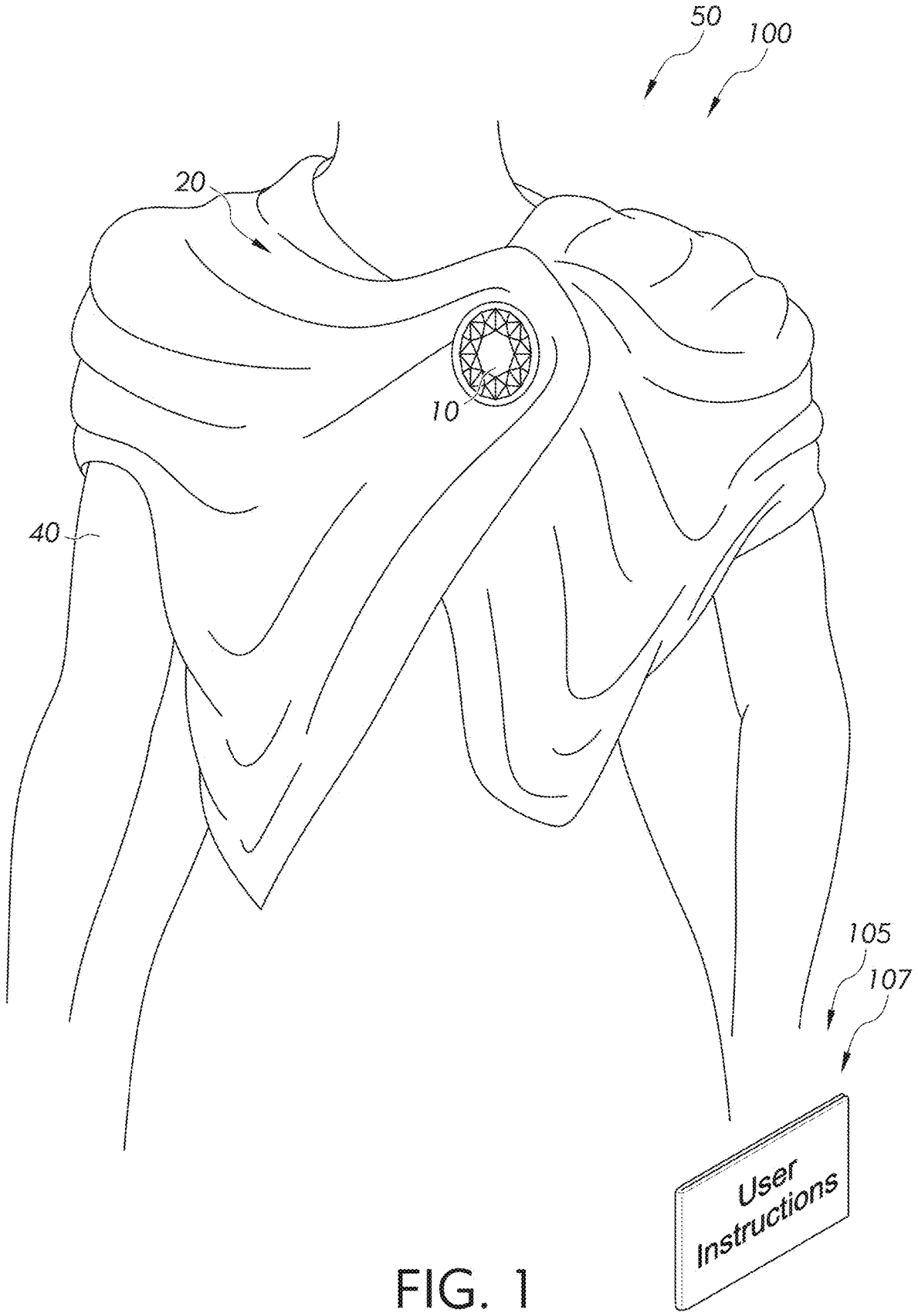
FIG. 1 is a perspective view of the accessory fastener during an 'in-use' condition, according to an embodiment of the disclosure.

As discussed above, embodiments of the present disclosure relate to clothing fasteners for wearable accessories and more particularly to an accessory fastener as used to improve the magnetic coupling of an accessory to a fabric item or other surface.

Generally, the accessory fastener is an assembly including covered, polished, coated, or partially covered magnets (which may vary in strength and size), a wearable accessory couple, and an additional mounting fastener (e.g., back clip), all of which are arranged and configured to attach a wearable accessory (e.g., a broach) to an item of fabric such as a dress. Aspects of the disclosure may include one or more of the magnets, clip, and broach incorporating discontinuities (e.g., discontinuitys, protrusions, edges, etc.) configured to resist lateral movement (e.g., that fit into each other to ensure a lock). Once put in place, these magnets should not move unintentionally. There may be a small bevel on at least one of the magnets, which may be useful for prying the magnets apart more easily. The wearable accessories (e.g., broaches) may also come in different shapes and sizes, such as for dog collars, name tags, jeweled broaches, and more. It should be appreciated that the present disclosure is not limited to the magnets and clip for fastening purposes, and that other fastening mechanisms may be used. For example, adhesives, hook and loop fasteners, hook and eye fasteners, and the like may be utilized.

In one embodiment, the accessory fastener may feature a fabric shield (or protective layer) on at least one of the included magnets, configured for eliminating or at least reducing damage to a fabric item that may be placed between the magnets. This fabric shield may be configured as a fabric covering. The fabric covering may consist of silk, felt, or any other fabric that is useful for minimizing wear and friction. The fabric covering may completely envelop the magnets or exist on at least a portion of the magnets. The fabric shield may also be configured as a protective coating. The protective coating may be applied to at least part of the magnets as a layer of teflon or other protective surfacing. Additionally, the fabric shield may be configured as a finish or polish applied to at least a portion of the magnets. By polishing the magnets, the coupling surfaces may be smoothed out to an appropriate level for reducing friction and wear on a fabric item interspersed within the magnets.

The accessory fastener may have extensive application beyond wearable accessories. It can be arranged and configured for dog collars to hold the dog tag in place. It can also be applied as a locking broach for cloth items. For example, the accessory fastener may be configured as a clothing support (e.g., to keep a shawl in place). Also for example, the accessory fastener may be configured for home décor purposes. To illustrate, the accessory fastener may be include more powerful magnets and the accessory may be embodied as a curtain decoration, which may then hold the curtains in place using via the magnets and to lock a holding strap. Also for example, the accessory fastener may be configured for to decorate luggage, again with sufficiently powerful magnets, and also with low profile accessories.

Referring now more specifically to the drawings by numerals of reference, there is shown in FIGS. 1-4, various views of an accessory fastener 100. FIG. 1 shows an accessory fastener 100 during an 'in-use' condition 50, according to an embodiment of the present disclosure. Here, the accessory fastener 100 may be beneficial for use by a user 40 to removably secure an accessory 10 to a fabric item 20 or other surface.

According to one embodiment, the accessory fastener 100 may be arranged as a kit 105. In particular, the accessory fastener 100 may further include a set of instructions 107. The instructions 107 may detail functional relationships in relation to the structure of the accessory fastener 100 (such that the accessory fastener 100 can be used, maintained, or the like, in a preferred manner).

Figure 2:
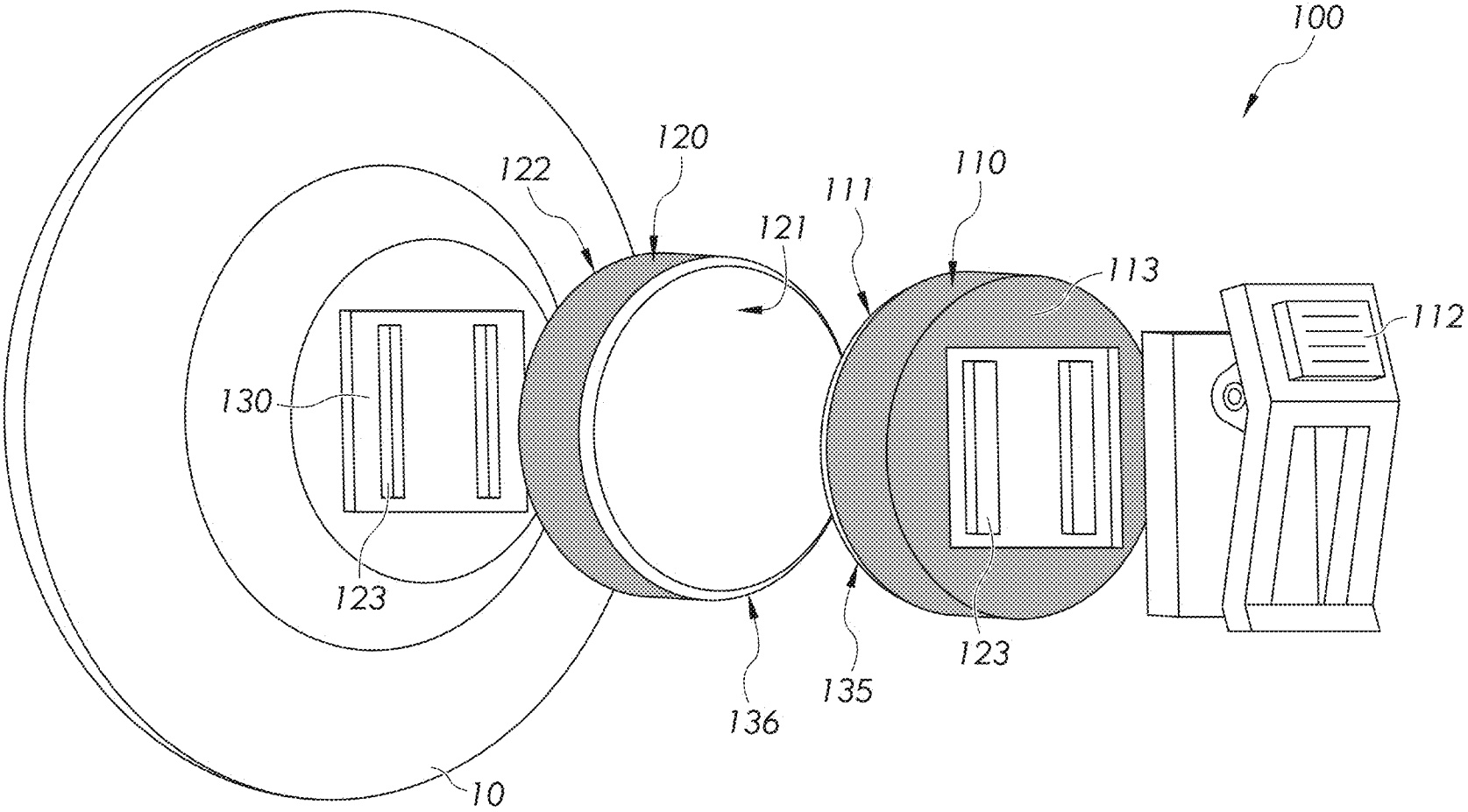
FIG. 2 is a back perspective exploded view of the accessory fastener of FIG. 1 further including a mounting fastener, according to an embodiment of the present disclosure.

FIG. 2 is a back perspective exploded view of the accessory fastener 100 of FIG. 1 further including a mounting fastener, according to an embodiment of the present disclosure. As shown, the accessory fastener 100 may include a back magnet 110, a front magnet 120, and an accessory coupling 130. According to one embodiment, the accessory fastener 100 may also include a mounting fastener 112.

The back magnet 110 may include a front beveled edge 135, a back face 113, and a back fabric-shield 111 covering at least a portion of the back magnet 110. The front magnet 120 may include a back beveled edge 136, a front face 122, and a front fabric-shield 121 covering at least a portion of the front magnet 120. The accessory coupling 130 may be configured to couple the accessory 10 to the front magnet 120. The mounting fastener 112 may be configured to couple with the back magnet 110.

According to one embodiment, at least one of the front magnet 120 and back magnet 110 may additionally include at least one discontinuity 123 configured to resist lateral movement of the accessory coupling 130 (e.g., across the front face 122 of the front magnet 120) and the mounting fastener 112 (across the back face 113 of the back magnet 130).

Figure 3:
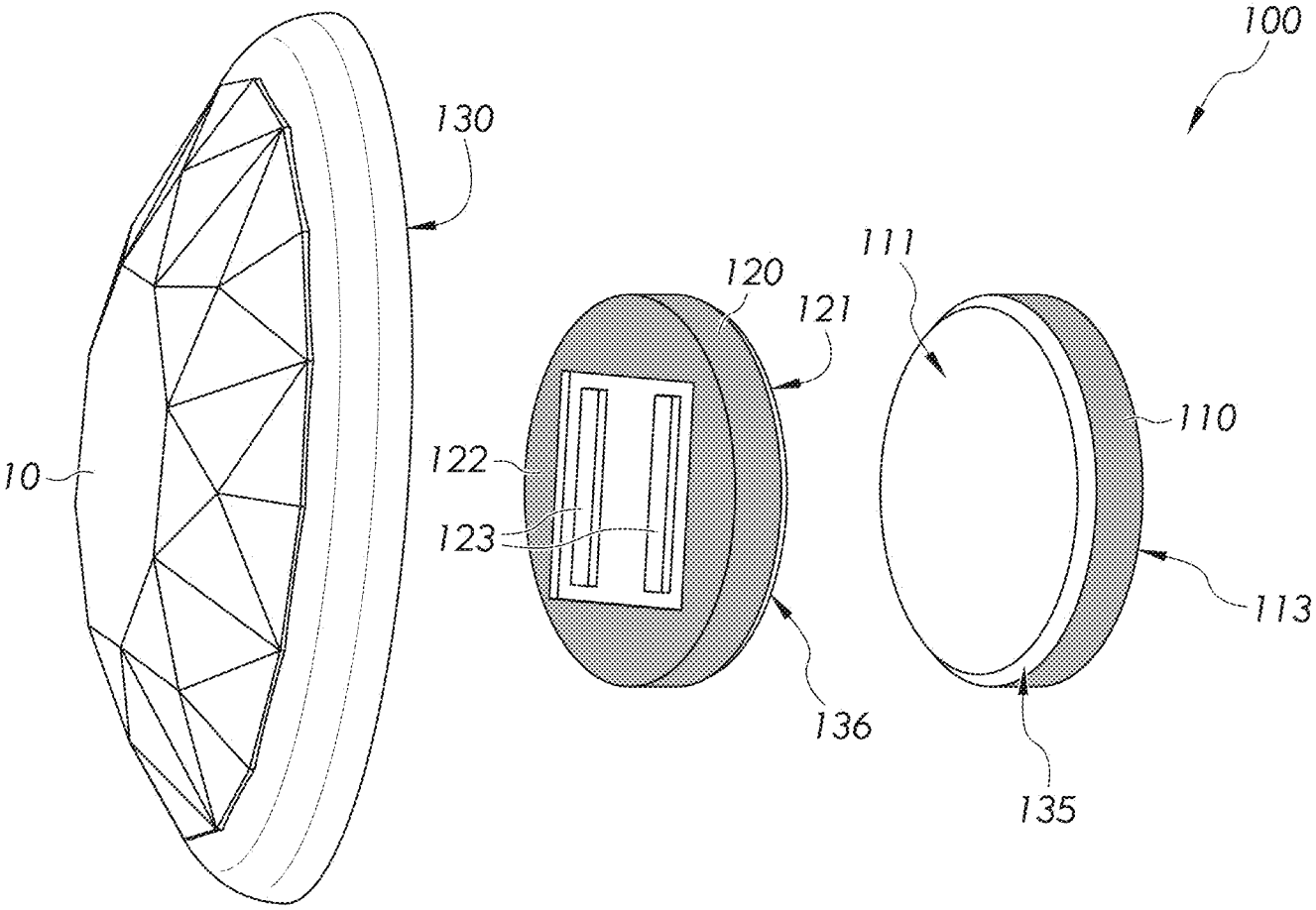
FIG. 3 is front perspective exploded view of the accessory fastener of FIG. 1, according to an embodiment of the present disclosure.

FIG. 3 is a front perspective exploded view of the accessory fastener 100 of FIG. 1, according to an embodiment of the present disclosure. This illustration shows an alternate application for the accessory fastener 100 comprising an accessory 10 fixed to the front face 122 of the front magnet 120 by means of the accessory coupling 130. Further, the front magnet 120 includes at least one discontinuity 123 (here, two parallel bars extending from the front face 122 of the front magnet 120). This illustration also shows the back magnet 110 featuring a front beveled edge 135, that is in position to be coupled with the front magnet 120.

As above the back magnet 110 may include the back fabric-shield 111 and the front magnet 120 may include the front fabric-shield 121. The back fabric-shield 111 and the front fabric-shield 121 are configured to shield the magnetically clamped fabric from damage and wear. As discussed above, the back fabric-shield 111 and the front fabric-shield 121 may cover, partially cover the back magnet 110 or the front magnet 120, respectively, or may be integrated with the back magnet 110 or the front magnet 120, respectively, for example as polished finish, or coated face/surface.

Figure 4:
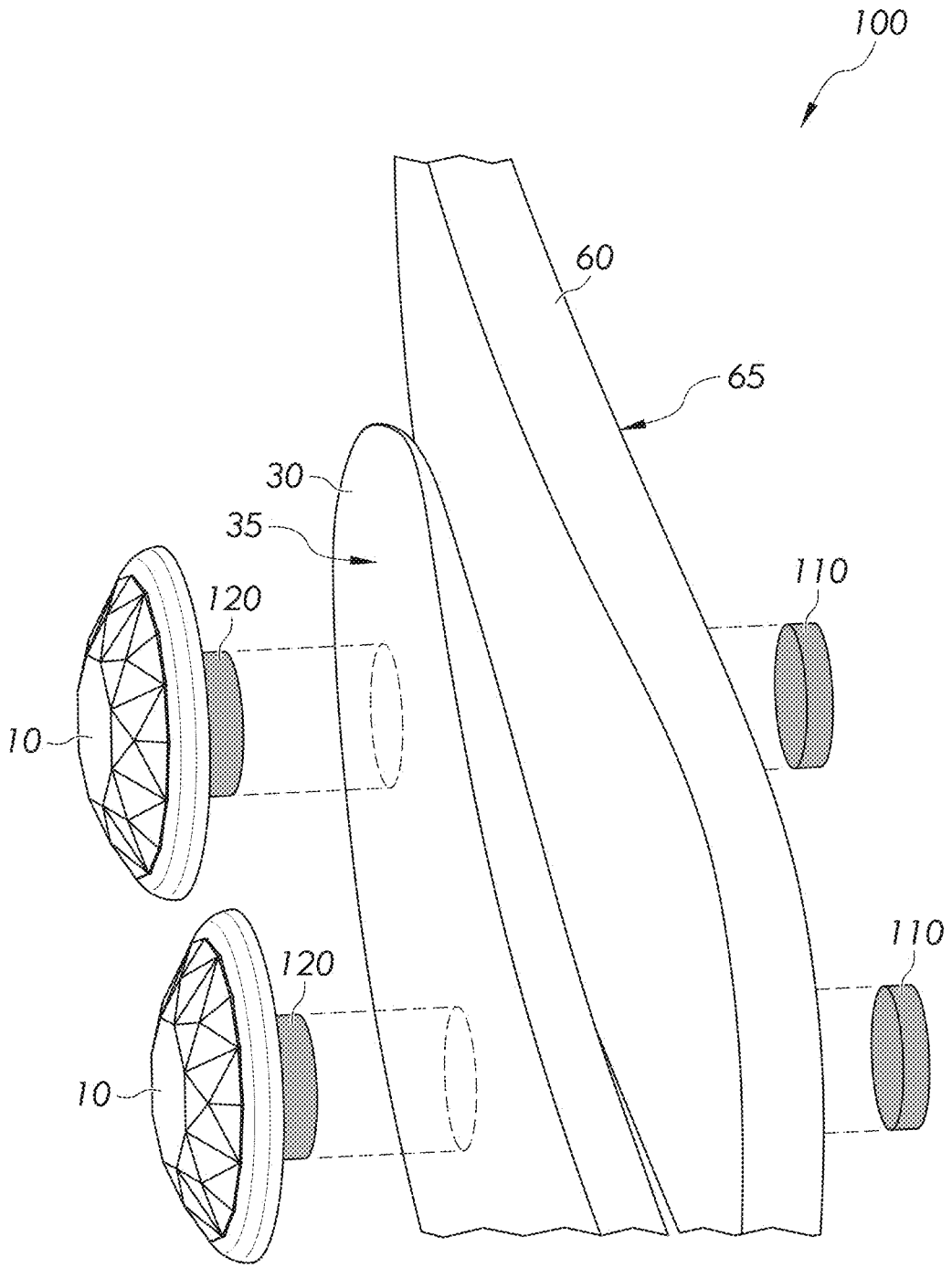
FIG. 4 is a side perspective view of a pair of accessory fasteners coming together with fabric items therebetween, according to an embodiment of the present disclosure.

FIG. 4 is a side perspective view of the accessory fastener 100 of FIG. 1, according to an embodiment of the present disclosure. In particular, here a pair of the accessory fastener 100 are used to couple a first fabric item 30 to a second fabric item 60, As above, the accessory fastener 100 may be used to fix an accessory 10 to a front magnet 120 on the front side 35 of the first fabric item 30 and hold the front magnet 120 in position by magnetically coupling with a back magnet 110 configured to interface with the back side 65 of the second fabric item 60.

Figure 5:
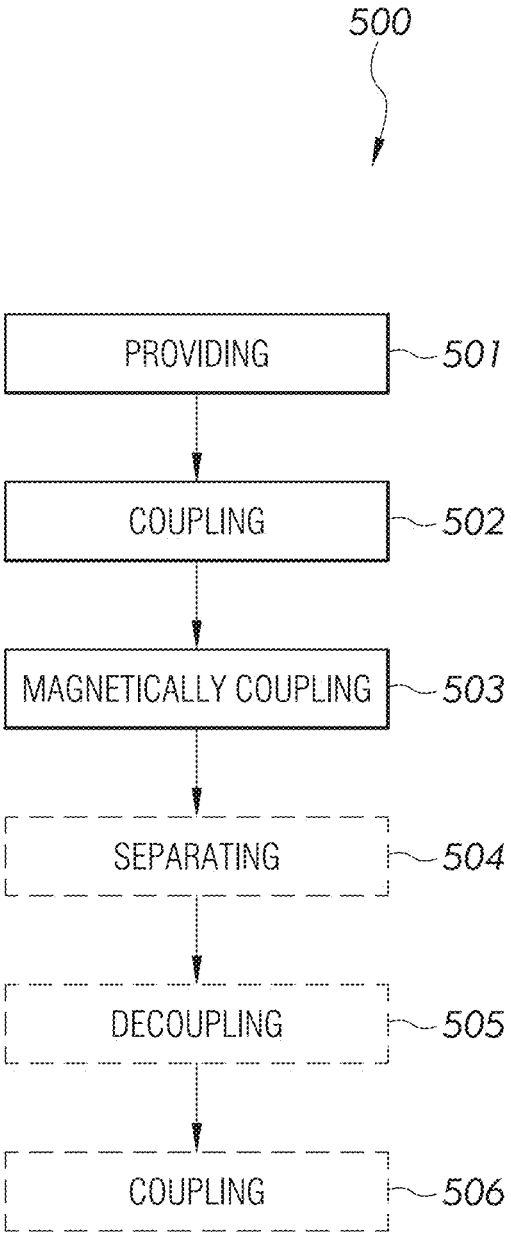
FIG. 5 is a flow diagram illustrating a method of use for the accessory fastener according to an embodiment of the present disclosure.

FIG. 5 is a flow diagram illustrating a method 500 for fastening an accessory 10 to a fabric item 20, according to an embodiment of the present disclosure. In particular, the method 500 may include one or more components or features of the accessory fastener 100 as described above. As illustrated, the method 500 may include the steps of: step one 501, providing the accessory fastener 100 (e.g., the accessory fastener 100 may include a back magnet 110 including a front beveled edge 135 and a back fabric-shield covering at least a portion of the back magnet 110, a front magnet 120 including a back beveled edge 136 and a front fabric-shield covering at least a portion of the front magnet 120, the front magnet 120 configured to magnetically couple with the back magnet 110 while the fabric item is interspersed therebetween, and an accessory coupling 130 fixed to the front magnet 120 and configured to removably couple with the accessory 10); step two 502, coupling the accessory 10 to the front magnet 120 via the accessory coupling 130; and step three 503, magnetically coupling the front magnet 120 to the back magnet 110 with the fabric item 20 interspersed there between such that the accessory 10 is affixed to the fabric item 20. According to one embodiment, the method 500 may further include step four 504, separating the front magnet from the back magnet; step five 505, decoupling the accessory from the front magnet via the accessory coupling; and step six 506, coupling a new accessory to the front magnet via the accessory coupling.

It should be noted that step four 504, step five 505, and step six 506 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for the accessory fastener 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An accessory fastener for an accessory and a fabric item, the fabric item having a back side and a front side opposite the back side, the accessory fastener comprising:

a back magnet including a back fabric-shield covering at least a portion of the back magnet and configured to interface with back side of the fabric item;

a front magnet including a front fabric-shield covering at least a portion of the front magnet and configured to interface with front side of the fabric item, the front magnet configured to magnetically couple with the back magnet while the fabric item is interspersed therebetween;

an accessory coupling fixed to the front magnet and configured to removably couple with the fabric item;

and a mounting fastener having a first side and a second side opposite the first side, the mounting fastener configured to couple with the back magnet at the first side, to fasten the accessory fastener to a separate item at the second side, and to support the accessory fastener from the separate item;

and wherein the accessory coupling is further configured to separately couple with a plurality of accessories;

wherein the accessory coupling is removable from the front magnet;

wherein each of the front magnet and back magnet are cylindrically-shaped and have a diameter of at least 1 centimeter, respectively;

wherein the accessory coupling is selected from a list of items including adhesive tape, spring clips, hardware, glue, and hook-and-loop fasteners;

wherein the front magnet and back magnet are configured to magnetically couple with each other with at least 0.5 lbs. of magnetic coupling force while the fabric item is interspersed there between;

wherein the front magnet is substantially cylindrical in shape;

wherein the back magnet is substantially cylindrical in shape;

wherein the front magnet has a beveled edge extending about a periphery of the front magnet;

wherein the beveled edge extends at least 1 millimeter inward from the periphery of the front magnet;

wherein the front magnet has a front face, and includes at least one discontinuity configured to resist lateral movement of the accessory coupling across the front face of the front magnet;

wherein the back magnet has a back face, and includes at least one discontinuity on said back face configured to resist lateral movement of the mounting fastener;

wherein the fabric item has a thickness between its front side and its back side of up to 2 mm;

wherein the fabric item is constructed from a material selected from a group including cotton, polyester, leather, nylon, wool, rayon, silk, burlap, mesh, and plastic; and wherein the back magnet is further configured to couple with a flat surface.

2. The accessory fastener of claim 1, further comprising set of instructions; and wherein the accessory fastener is arranged as a kit.

3. A method for fastening an accessory to a fabric item, the method comprising the steps of:

providing the accessory fastener of claim 1;

coupling the accessory to the front magnet via the accessory coupling; and magnetically coupling the front magnet to the back magnet with the fabric item interspersed there between such that the accessory is affixed to the fabric item.

4. The method of claim 3, further comprising the steps of:

separating the front magnet from the back magnet;

decoupling the accessory from the front magnet via the accessory coupling;

and coupling a new accessory to the front magnet via the accessory coupling.

* * * * *